US010273740B2

(12) United States Patent
Gibson

(10) Patent No.: US 10,273,740 B2
(45) Date of Patent: Apr. 30, 2019

(54) PORTABLE SAFE

(71) Applicant: Daryl Thomas Gibson, Brooklin (CA)

(72) Inventor: Daryl Thomas Gibson, Brooklin (CA)

( * ) Notice: Subject to any disclaimer, the term of this patent is extended or adjusted under 35 U.S.C. 154(b) by 0 days.

(21) Appl. No.: 15/909,059

(22) Filed: Mar. 1, 2018

(65) Prior Publication Data

US 2018/0252018 A1 Sep. 6, 2018

Related U.S. Application Data

(60) Provisional application No. 62/466,457, filed on Mar. 3, 2017.

(51) Int. Cl.
*E05G 1/00* (2006.01)
*E05B 73/00* (2006.01)

(52) U.S. Cl.
CPC ..... *E05G 1/005* (2013.01); *E05B 73/0005* (2013.01)

(58) Field of Classification Search
CPC ..... E05G 1/005; E05B 73/0005
USPC ..... 70/63, 64, 68, 65–67; 109/23, 24, 57, 109/50–52; 248/551–553; 150/101, 102, 150/112, 113; 190/101, 102, 109, 110; 383/5
See application file for complete search history.

(56) References Cited

U.S. PATENT DOCUMENTS 1,532,710 A * 4/1925 Nellegar, Jr. ..... A45C 13/20 190/101
1,805,759 A * 5/1931 Chamberlain ..... E05G 1/00 109/51
2,755,748 A 7/1956 Abell, Jr.
3,881,534 A 5/1975 Gist
4,325,531 A * 4/1982 Omholt ..... B62J 9/00 224/42.4
4,488,624 A * 12/1984 Myers ..... A45C 3/00 190/120
4,573,332 A 3/1986 Ma
4,667,491 A 5/1987 Lokken et al.
4,804,122 A 2/1989 Knox
4,986,457 A * 1/1991 Faris ..... E05B 73/0005 223/1
5,531,082 A 7/1996 Wolk et al.
5,819,561 A * 10/1998 Blehi ..... E05B 67/36 70/14
6,085,671 A 7/2000 Kerr et al.
6,155,715 A * 12/2000 Lake ..... A47G 29/20 150/102
6,581,421 B2 * 6/2003 Chmela ..... E05B 73/0005 403/291
6,604,390 B1 * 8/2003 Nooner ..... B65D 55/14 109/50

(Continued)

*Primary Examiner* — Lloyd A Gall
(74) *Attorney, Agent, or Firm* — Powley & Gibson, P.C.

(57) ABSTRACT

A safe that may be secured to a fixed object while incorporated in a larger bag is provided. Also provided is a kit including a safe that can be installed in an existing bag. In use, the bag and safe are secured together and both may be simultaneously locked to a fixed object by a securing mechanism such as a loop cable with a locking mechanism. The securing mechanism enters both the bag and the safe through apertures which may be reinforced. The securing mechanism may be detached from the safe by detaching removable fasteners designed to secure the mechanism within the safe. The interior of the bag may also comprise a housing or a mounting mechanism to secure the safe within the bag.

12 Claims, 8 Drawing Sheets

(56) References Cited

U.S. PATENT DOCUMENTS

| | | | | |
|---|---|---|---|---|
| 7,305,858 | B1 | 12/2007 | Wu | |
| 7,360,379 | B1 * | 4/2008 | Lopez | E05B 37/0034 206/320 |
| 7,401,482 | B1 * | 7/2008 | Shaw | A45C 1/12 109/45 |
| 7,540,175 | B2 * | 6/2009 | Kalous | E05G 1/005 109/50 |
| 8,117,973 | B1 * | 2/2012 | Frank | E05G 1/005 109/47 |
| 9,822,578 | B2 | 11/2017 | Peck et al. | |
| 9,926,108 | B2 * | 3/2018 | Wiley | B65D 33/00 |
| 2004/0045329 | A1 * | 3/2004 | Farnham | E05B 73/0005 70/63 |
| 2006/0137413 | A1 * | 6/2006 | Yu | A45C 13/18 70/63 |
| 2009/0044736 | A1 * | 2/2009 | Huber | E05G 1/005 109/51 |
| 2009/0266722 | A1 * | 10/2009 | Rogers | B65D 33/25 206/216 |
| 2012/0217371 | A1 * | 8/2012 | Abdollahzadeh | E05B 15/1607 248/551 |
| 2012/0248106 | A1 * | 10/2012 | Marta | B65D 21/086 220/8 |
| 2012/0298018 | A1 * | 11/2012 | McCabe | A45C 13/20 109/51 |
| 2015/0000571 | A1 * | 1/2015 | Stemen | E05G 1/005 109/23 |
| 2016/0053525 | A1 | 2/2016 | McMurray | |
| 2018/0202199 | A1 * | 7/2018 | Critz | E05B 73/0023 |

* cited by examiner

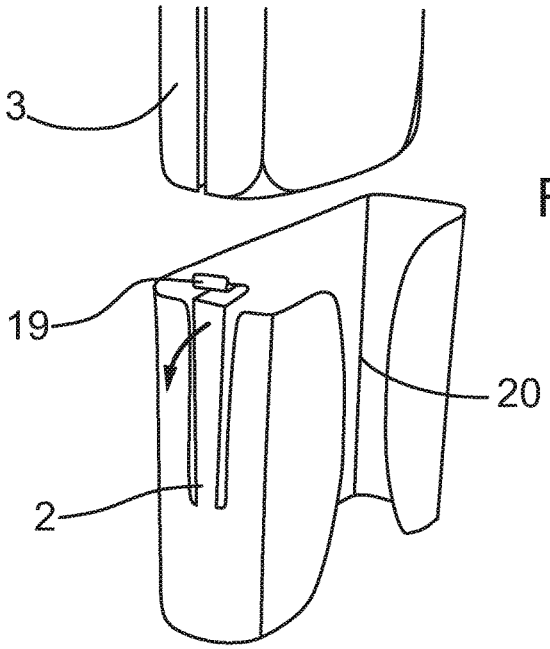
Fig. 8
Fig. 9
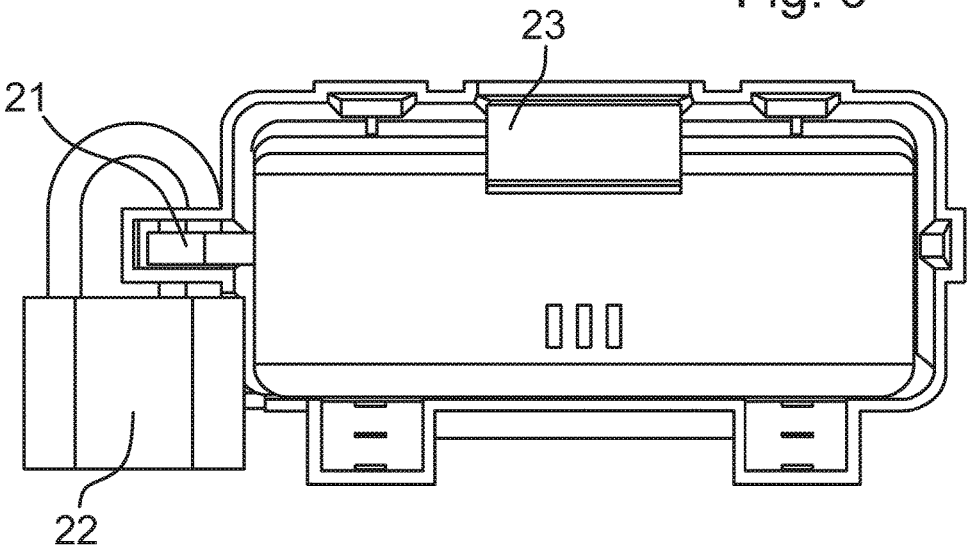

PORTABLE SAFE

CROSS REFERENCE TO RELATED APPLICATIONS

The present application claims the benefit of U.S. Provisional Application No. 62/466,457, filed on Mar. 3, 2017, and is incorporated herein by reference.

FIELD OF THE INVENTION

The present invention relates to a portable safe which may be incorporated in a bag, and which includes mechanisms for installing the safe into a bag and securing it to a fixed object.

BACKGROUND OF THE INVENTION

Personal bags with security features are desirable for carrying valuables on-the-go. At a minimum, a typical person in current times will carry a mobile phone, bank and credit cards, cash, and keys. While travelling, playing sports, or when attending outdoor venues such as a beach or park, one may be required to leave a bag containing such items unattended or out of view. Unattended bags are suitable targets for thieves, increasing the risk of valuables being lost or stolen.

A variety of bags with security features are known. The most common bags known contain some form of locking mechanism for the purpose of securing valuables within the bag. The principal weakness of such bags is their relative inability to deter theft of the entire bag and hence the valuables within. This weakness is due to the fact that known bags with security features are not equipped with a seamless locking system that allows a user to secure both a bag and a secured compartment containing valuables to a fixed object simultaneously.

For example, some bags are sold with modest sized locks to secure the external zippers, thereby protecting contents from unwanted removal. Other similar bags possess additional security features such as cut proof zippers or a durable slash-resistant outer shell or casing. These features render the bag more difficult to pierce, although the bag can still be compromised. The visibility of the locking mechanism on the bag's exterior also presents a single point of weakness in the bag's security. The prominent visibility of a lock alone signals that a bag likely contains valuables worth securing, attracting unwanted attention.

Portable containers or safes that can be secured to fixed objects are also known. These objects would enable users to carry their valuables on-the-go and to secure them to a fixed object such as a fence. A key weakness of portable safes is their visibility. Just as a lock signals that a bag is likely to contain valuables, the visibility of a safe may also attract similar attention. Further, should a user take caution to conceal the portable safe within a personal bag, known bags are not designed to seamlessly secure both the portable safe and the personal bag together and to a fixed object simultaneously.

Other known mobile safes may be used to store small valuables such as car keys, and such devices may be attached to the underside of a car and thereby hidden. However, they are not configured to also hold other commonly carried items such as mobile phones or cards. Such devices are also limited in terms of the object to which they may be attached, as they typically require a magnetic surface.

Therefore, there is a need for an anti-theft safe and associated bag, the safe having a locking mechanism that can easily secure an internal safe contained within the bag to virtually any fixed object.

SUMMARY OF THE INVENTION

The general object of the present invention is to provide an improved anti-theft safe which may be optionally incorporated in a bag with a locking mechanism that can seamlessly secure both the safe and the bag to a fixed object simultaneously.

In another aspect, the anti-theft safe may be provided with additional components in a kit to facilitate its installation into a bag of the user's choice. Such additional components may include a base to secure the safe into a bag, and means to facilitate the creation and reinforcement of apertures in the bag through which a locking mechanism can exit the bag for use in securing the safe and bag.

In a further aspect, the safe may be provided pre-installed in a bag, with the locking mechanism configured to protrude from apertures provided in both the safe and the bag.

In a still further aspect, the safe may be installed in a bag and the locking mechanism may be configured to protrude from an existing opening for the bag. If the bag is equipped with a two-way zipper, the zipper ends can be further secured together using known means after the locking mechanism is arranged to protrude from the zippered section of the bag.

As embodied and broadly described below, the present invention provides a portable safe and securing mechanism designed to secure valuables to a fixed object, said safe being designed to be installed in a larger bag. In a preferred embodiment, the invention includes a safe structure comprising an outer housing component, an inner cavity container and a door secured to the inner cavity container.

In a preferred embodiment, the safe is also comprised of one or more apertures designed to accept a securing mechanism such as a lockable loop cable. The bag also includes corresponding apertures, which may be reinforced, also designed to accept the loop cable. Other forms of locking mechanisms are also possible, as described more particularly below.

A loop cable may have two ends and be configured to include a pair of removable fasteners designed to be secured over the two ends of the loop cable while said ends are contained within the safe. The purpose of these removable fasteners is to secure the ends of the loop cable through the personal bag and within the safe, therefore seamlessly securing both the bag and safe to a fixed object. A loop cable can also be detached from the safe. This is done by deactivating the safe locking mechanism, opening the safe door and removing the fasteners from at least one end of the loop cable. Alternatively, the loop cable may be connected to the safe by only one end, the other end including a locking mechanism that can be used to lock the cable to itself.

In one preferred embodiment, an outer housing component for the safe is housed within a mounting mechanism which is in turn secured to an inner wall of a bag. The mounting mechanism is secured to the bag by known means, such as a plurality of rivets or a holster. Alternatively the outer housing component may be secured to the bag by any other means, such as through use of a hook and loop closure system (commonly known as VELCRO™), any adhesive, stitching, or any other known method of securing components together.

In another preferred embodiment, the outer housing component of the safe is housed within a mounting mechanism that contains a corresponding pair of integrally molded loops. The integrally molded loops enable the safe to be housed securely within the mounting mechanism using a suitable locking device, such as a u-shaped lock. A snappable flange, clip, latch, fastener, or other suitable means, may also be used to hold the safe in place and prevent its movement while housed within the mounting mechanism. Further apertures on an appropriate wall of the mounting mechanism may be used so that the locking device can pass through the mounting mechanism.

In an alternative embodiment, a loop cable may also be provided with one or more durable grommets or eyelets designed to accept the loop cable when threaded through a bag, thereby enabling the safe to be secured to the bag. In this embodiment, the durable eyelets are provided to facilitate the installation of the above described safe and loop cable mechanism within a suitable bag of choice. The grommets are installed into a bag by simply piercing one or more holes at an appropriate distance through the desired side of the bag, preferably the bottom end, back side, or a portion that is contained within a pocket of the bag. Once the holes are formed, the grommets are pushed through the holes and crimped to the holes with a suitable device such as pliers, thereby reinforcing the holes. This alternate embodiment allows consumers to install the above described safe and loop cable mechanism to improve the security of an existing bag.

Such an anti-theft safe and bag will provide the multiple functions of allowing a user to hide valuables, and to temporarily secure them to a stationary object, so as to discourage theft. Advantageously, when installed in a bag, the safe itself is not visible. The larger bag serves to obscure the safe from view. Although the locking mechanism such as a loop cable would protrude from the safe and bag when in use, the visibility of the cable may be minimized so that it is not easily seen, by, for example, tucking away extra lengths of cable within or under the bag.

Even if the safe and bag, while in use, do come to the attention of a potential thief, it is known that petty theft is typically a crime of opportunity. A potential thief will likely move on to easier targets rather than try to access valuables that have been secured using the invention described herein.

BRIEF DESCRIPTION OF THE DRAWINGS

The present invention will now be better understood with reference to the description and to the accompanying drawings in which:

FIG. 8 shows a front perspective view of an embodiment of the outer housing component of the safe and how the safe may be mounted within the housing.

FIG. 9 shows a side perspective view of an embodiment of the outer housing component of the safe, and how a safe may be securely attached to the housing.

In these figures, preferred embodiments of the invention are illustrated by way of examples. It is to be expressly understood that the description and drawings are only for the purpose of illustration and are an aid for understanding. They are not intended to define the limits of the invention.

DETAILED DESCRIPTION OF THE PREFERRED EMBODIMENTS

As used herein, any usage of terms that suggest an absolute orientation (e.g. "top", "front", "back" etc.) are for illustrative convenience and refer to a specific orientation. However, such terms are not to be construed in a limiting sense as it is contemplated that various components will, in practice, be utilized in orientations that are the same as, or different than those described or shown.

Figure 1:
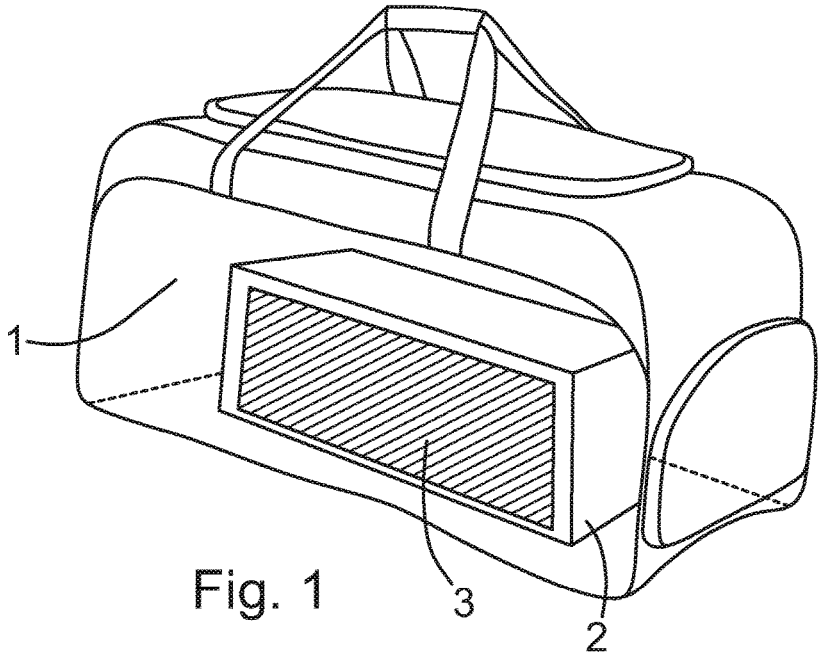
FIG. 1 is a side perspective view of an embodiment of the bag with a safe.

Turning now to the figures, FIG. 1 discloses a bag 1 which includes an embedded safe structure formed in multiple parts. While the bag would be made of an opaque fabric or other material so as to obscure the contents, in FIG. 1 the bag is shown as having a transparent side for the purposes of illustration of the components. Part 3 is the safe itself. Part 2 is an outer housing which is attached to the interior of bag 1 by any suitable means, such as rivets, staples, VELCRO™, and/or adhesive. The purpose of part 2 is to provide a stable place in which the safe 3 may be fitted or clamped into the bag. Examples of how the outer housing 2 and safe 3 may be fitted together are later shown in FIG. 8 following.

While the outer housing 2 may be made from a hard plastic, metal, or composite, it may also be made from a more flexible material such as a plastic, padded fabric, nylon or rubber. Such flexible materials are advantageous in that they tend to be light-weight, and may be more easily attached to the bag. For instance, instead of requiring rivets, the housing when made from a padded fabric could be installed using a strong adhesive. Alternatively the housing could be installed using VELCRO™ straps or a pad on its exterior that mate with corresponding VELCRO™ straps or a pad that are glued or sewn into the bag. There are many ways in which the housing and securement means for the housing into the bag may be configured. Instead of the box-like structure shown, the housing could resemble a padded envelope with means to secure it into a bag interior.

The safe may be of any shape, but will most often have a generally rectangular or elongate shape to conveniently store valuables such as cards, wallets, keys, and mobile phones.

Figure 2:
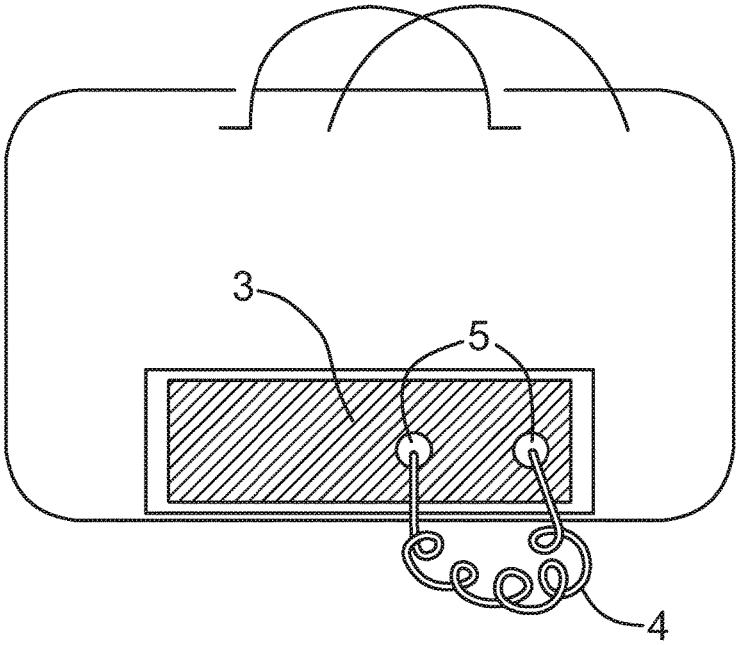
FIG. 2 is a front view of the bag with a safe and attached loop cable.

FIG. 2 shows a loop cable 4 entering the safe through apertures 5, preferably located on the back or bottom side of safe 3 which has been incorporated into a bag. The apertures 5 are designed to accept loop cable 4, and may be reinforced so that they do not become damaged or worn as loop cable 4 is threaded through. While two apertures 5 are shown in the embodiment in FIG. 2, the invention would also function well with a single aperture through which both ends of the loop cable 4 are threaded.

The apertures 5 may be visible from the outside of the bag as shown in FIG. 2, or they may be obscured. For instance, a covering or trap door made from the same material as the bag may be used to cover the apertures 5 when not in use. The covering may be hinged and can be closed around the apertures 5 by use of a zipper, VELCRO™ or other such means. Alternatively, large bags frequently have outer pockets incorporated into the sides or ends of the bags. It may be convenient to install the safe and housing in the bag, and align the apertures in a side wall of the bag such that they are contained within an existing pocket of the bag, and thereby hidden from external view.

Figure 3:
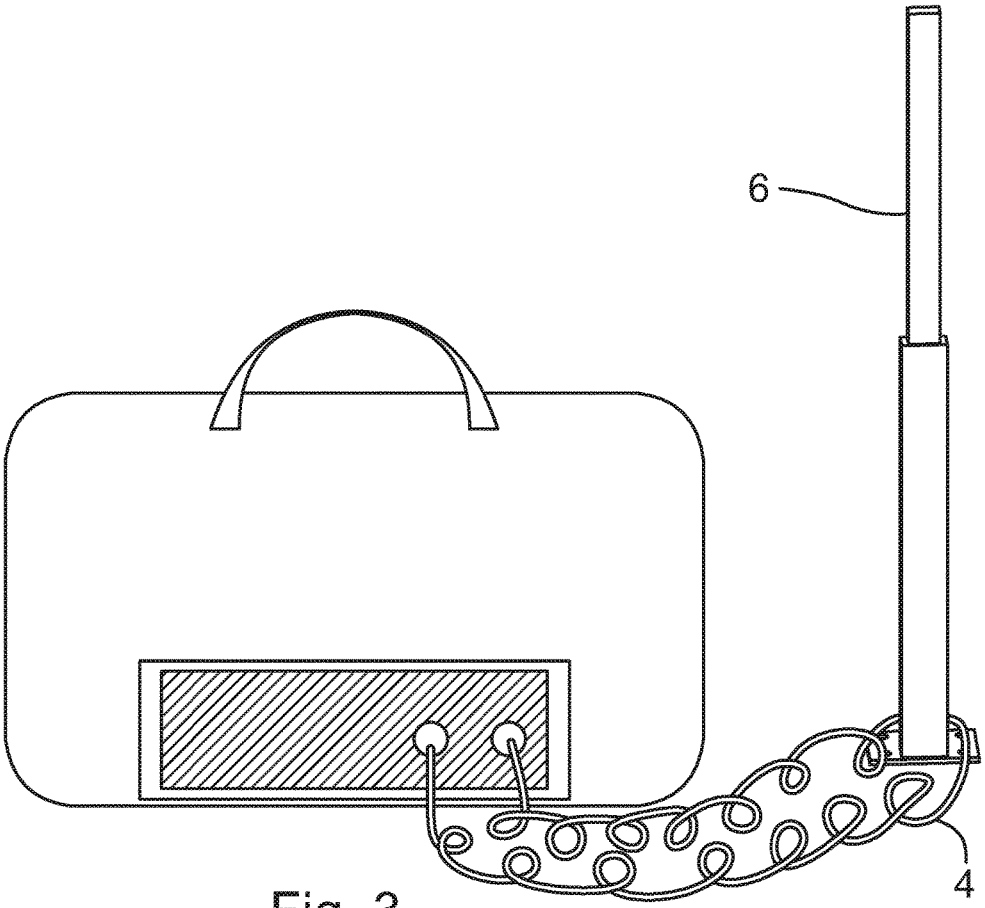
FIG. 3 is a front view of an embodiment of the bag with a safe and a loop cable secured to a fixed object.

In FIG. 3, the loop cable 4 has been secured around a stationary object 6, in this case a pole. To conveniently do so, one end of the loop cable is fed through the corresponding apertures and then looped around a desirable stationary object. All that then remains is to return the end of the loop cable 4 through the apertures in the bag and the safe, and then secure the end of the loop cable with a removable fastener as further shown in FIG. 4.

While a loop cable comprises an advantageous locking mechanism due to its versatility and light weight, it is also possible to use other locking means to secure the safe and bag to a stationary object, as long as the locking means could be accommodated by apertures in the bag. It is to be appreciated by a person of skill in the art that the form of the locking means is not particularly limited and can take many known forms. For example, a U-shaped lock that traverses the apertures could be used.

Figure 4:
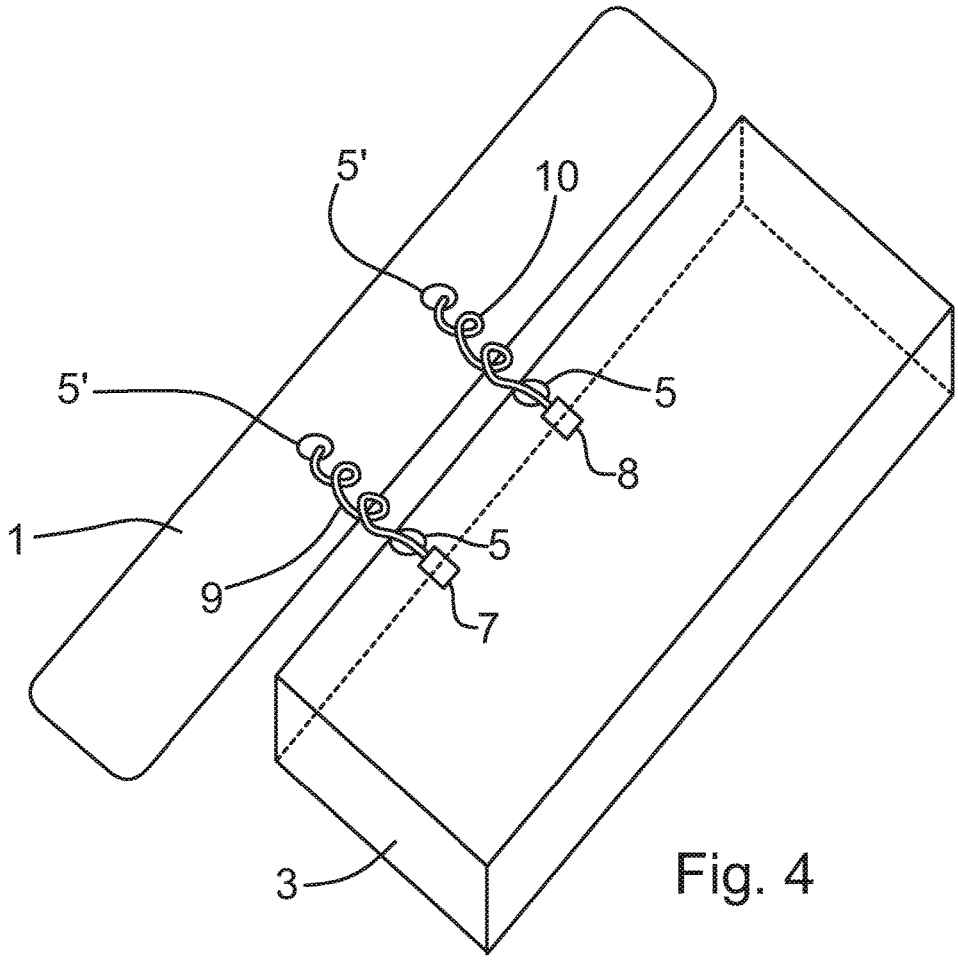
FIG. 4 is a top perspective view of the safe and a loop cable secured through the bag.

FIG. 4 shows an illustration of an embodiment by which loop cable 4 may be secured through bag 1 and safe 3. Loop cable 4 is provided with removable fasteners 7 and 8 secured about the ends 9 and 10 of the cable, and disposed within the safe 3. Loop cable 4 traverses both the apertures 5 of the safe as well as the corresponding apertures 5' of the bag. Removable fasteners 7 and 8 are of sufficient size that they cannot be pulled through the apertures 5 and 5'. In this way, once the loop cable 4 is wrapped around a stationary object and the fasteners 7 and 8 have been affixed to the ends 9 and 10 of the loop cable 4 in the interior of the safe 3, safe 3 and bag 1 further are effectively and securely tethered to the stationary object.

Figure 5:
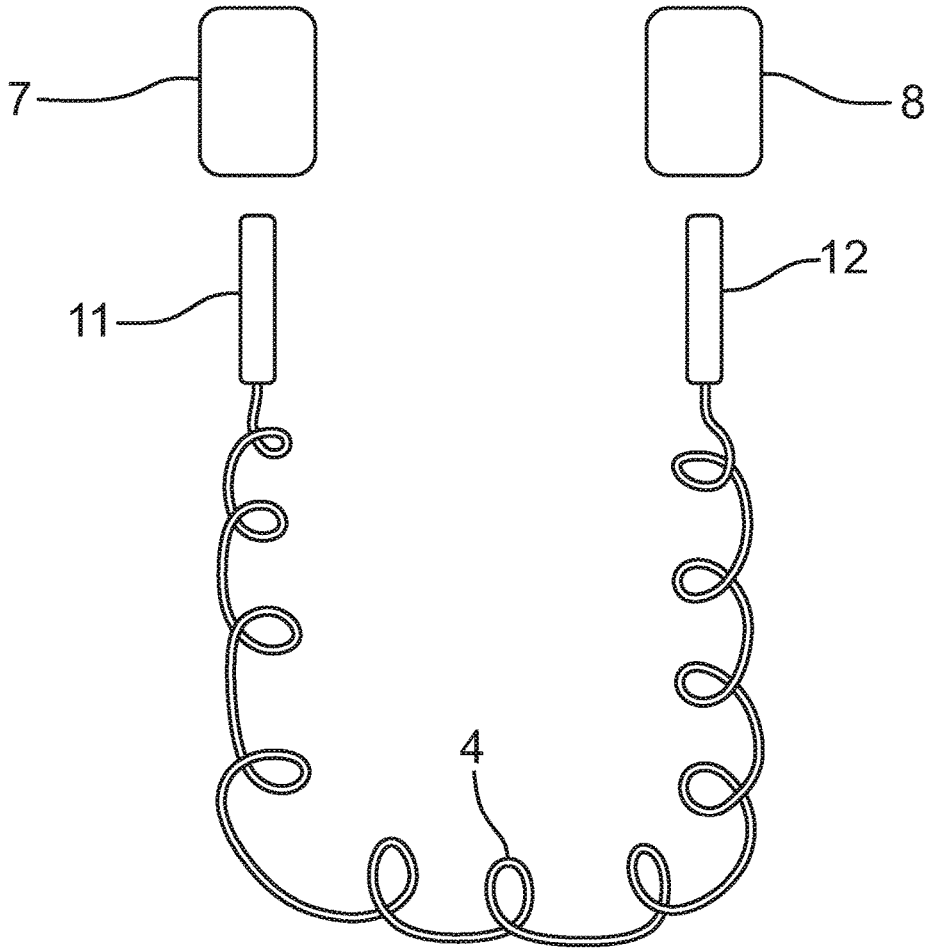
FIG. 5 shows a front view of the loop cable and removable fasteners.

FIG. 5 shows a preferred embodiment of loop cable 4 presented in isolation. Sheaths 11 and 12 are designed to accept and secure removable fasteners 7 and 8. Preferably, sheaths 11 and 12 have been securely crimped or clamped onto lock cable 4 and are threaded on their exterior surfaces. Removable fasteners 7 and 8 can thereby be threaded onto corresponding sheaths 11 and 12.

In an alternative embodiment, the safe need not be provided already installed in a bag. A safe 3 and loop cable 4 as described above may be provided in a kit that allows a user to retrofit a preferred bag to incorporate the safe 3. The kit may include an outer housing, adhesive or other installation means for securing the housing into the bag, durable grommets or eyelets to reinforce the apertures needed for the loop cable 4, and installation instructions. The grommets or eyelets can be installed into apertures which have been made in a chosen bag in order to reinforce them. Alternatively adhesive patches or tape can be used to reinforce the apertures so as to prevent fraying or tearing of said apertures in use. In this way the safe 3 can be provided for installation into an existing bag.

Figure 6:
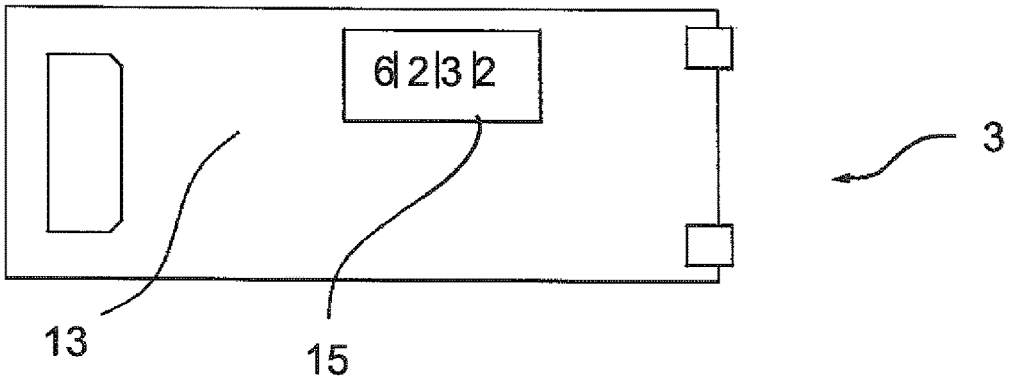
FIG. 6 shows a front view of the safe.

FIG. 6 shows a front view of the safe 3. It is a hollow structure with a door 13, designed to fit securely within the outer housing 2 (not shown in this drawing) and sized appropriately to hold valuables. The outer housing and safe may be made of any suitable durable material, preferably a light weight but strong material such as sheet steel or a shatter-resistant plastic. The door 13 shown in FIG. 6 is joined to the safe by any suitable means, such as by hinges. The door 13 can also be locked by any suitable locking mechanism such as the combination lockset 15 shown. Other locking mechanisms, such as a key lockset or an electronic lock, may also be used. Once valuables have been placed inside, the lock cable can be secured around a stationary object, and the ends of the lock cable 4 attached to the fasteners 7 and 8, thus preventing the removal of the lock cable 4 from the safe 3 and bag 1. Once the combination lockset 15 on the door 13 is engaged, the valuables are secured inside safe 3 and access to the ends of lock cable 4 is also prevented. This results in a secure containment of the valuables as well as the safe 3 and bag 1 being both securely affixed to a stationary object.

Figure 7:
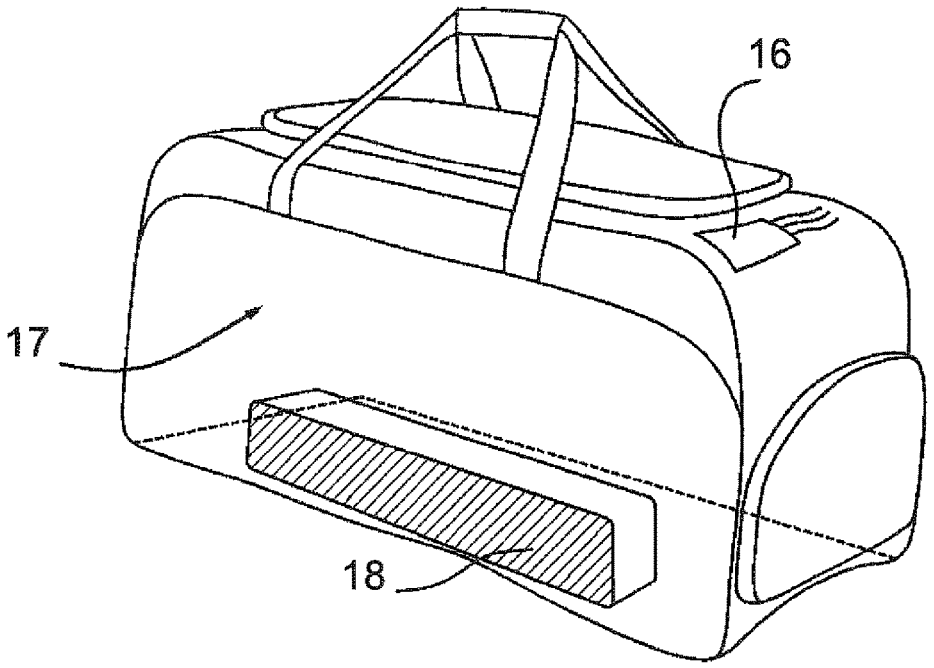
FIG. 7 shows a side perspective view of an embodiment of the bag containing a safe and also a GPS tracking device.

As illustrated in FIG. 7, the bag may also be comprised of a Global Positioning System tracking device 16 to assist a user in locating the bag should it be lost or stolen. The bag may also be comprised of a protective shell or padding 17, preferably made out of cut-resistant material, so as to reduce the likelihood of damage to valuables. As previously outlined above, in order to conceal the apertures 5' on the side of the bag 1 when not in use, a cover 18 made out of similar material to the bag 1 may be added over the exterior of apertures 5'. Said cover 18 can be attached by any suitable means that can allow access to the apertures 5'. For example, cover 18 may be attached along one side by stitching or by hinges. Closures such as velcro pads, buttons, snaps, or a zipper may be used to appropriately secure cover 18 over apertures 5' when lock cable 4 is not being used.

FIG. 8 displays a further preferred embodiment for safe 3 and its corresponding outer housing 2 comprising one or more open sides. The housing 2 can be secured to an inner wall of bag 1 with a plurality of rivets or other suitable means. Safe 3 can be secured into the mounting mechanism 2 by use of a snappable flange 19 as shown, or by any other suitable means.

Where such a housing 2 is used, as shown in FIG. 8, it may also be necessary to provide further apertures on an appropriate wall of the mounting mechanism 2 so that loop cable 4 can pass through housing 2. Alternatively, if apertures 5 in the safe 3 can be aligned with an open space on the housing 2 such as that shown as part 20, it will be unnecessary to provide for further apertures in housing 2.

Figure 10:
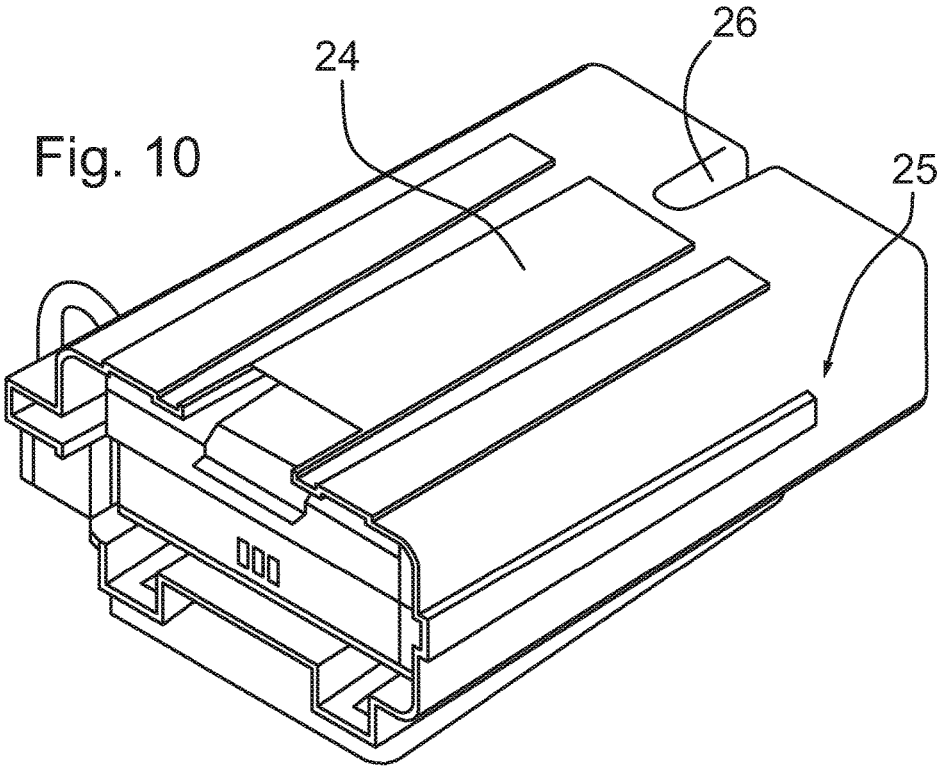
FIG. 10 shows a top perspective view of an embodiment of the outer housing component, with the safe mounted inside.
Figure 11:
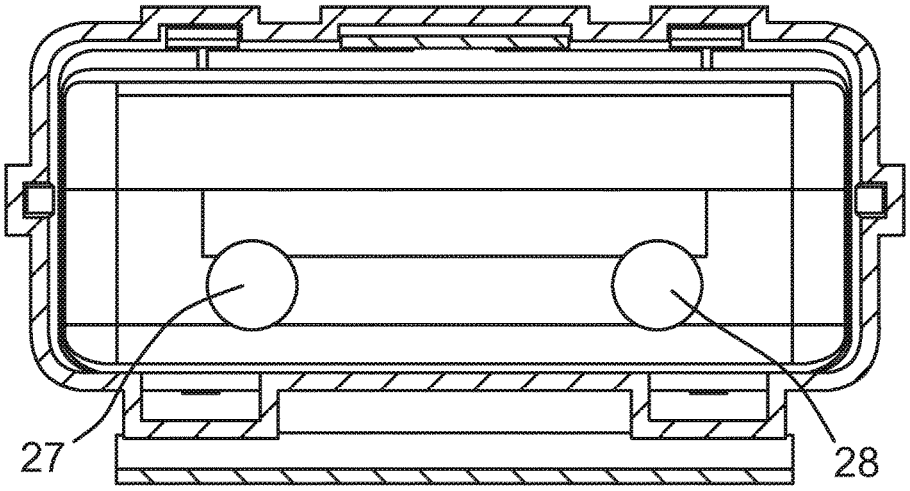
FIG. 11 shows an alternate side perspective view of an embodiment of the safe as contained in an outer housing component.

FIGS. 9, 10 and 11 display a further preferred embodiment for a mounting mechanism for the safe. The mounting mechanism itself can be secured into the bag by means of a mounting plate 24 through which rivets may be driven, or by adhesive or any other known means. The mounting mechanism as shown in FIG. 9 has two integrally molded loops 21 which can secure the safe which also has compatibly sized integrally molded loops. The securement can be achieved by means of a lock 22 as shown or by some other clasp or other suitable means. With this configuration it is also useful to provide a cutout 26 on one side of the housing to facilitate removal of the unlocked safe by allowing the user to push the safe out by reaching through the cutout.

The safe can further be held in place within the mounting mechanism 25 by use of a snappable flange 23, a clip, latch, or any other fastener. Where such a mounting mechanism 25 is used, as shown in FIGS. 9, 10, 11, further apertures 27 and 28 on an appropriate wall of the mounting mechanism 25 may also be provided so that a locking device such as the previously seen loop cable 4 can pass through mounting mechanism 25, and be used to secure the safe and bag to a stationery object.

Figure 12:
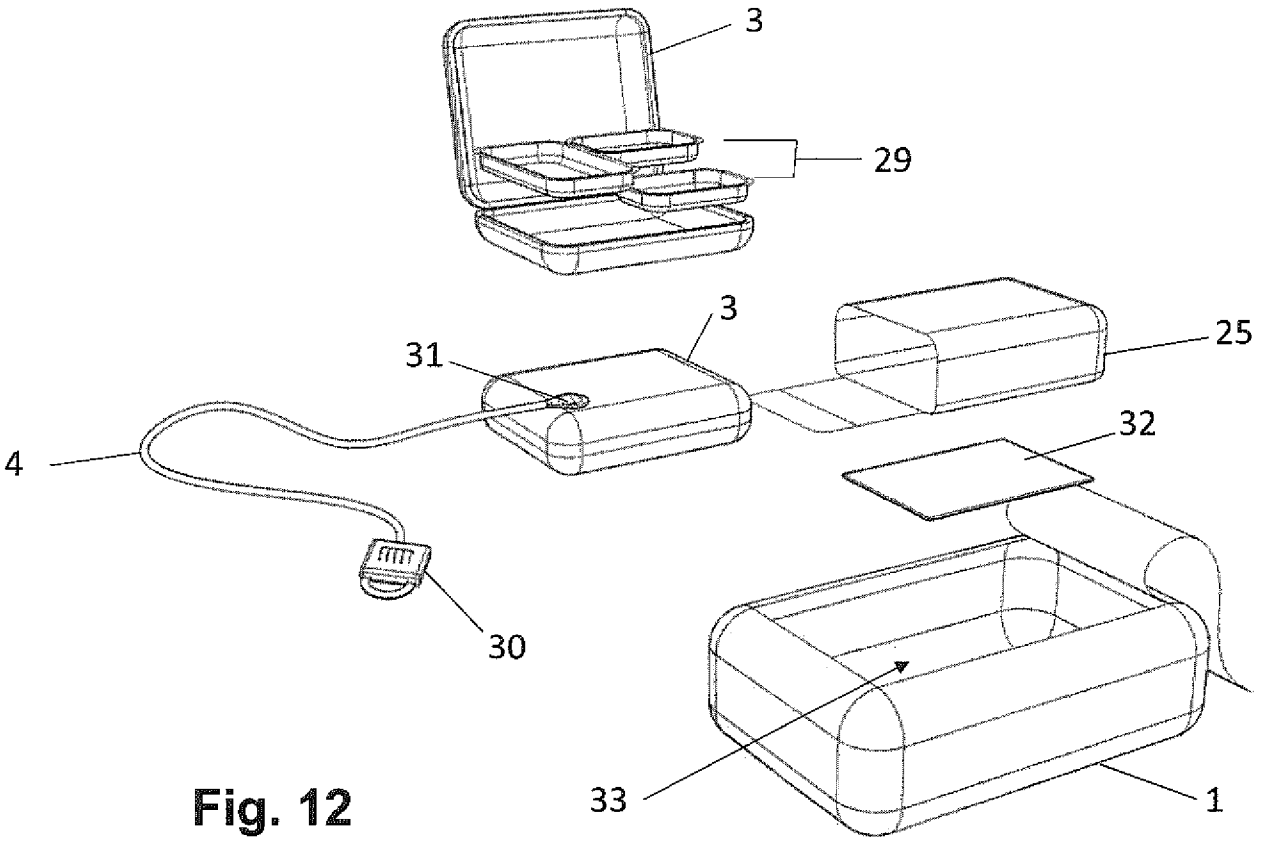
FIG. 12 shows a side perspective view of a further embodiment of the safe and a different form of loop cable, and how it may be incorporated into an existing bag.

In FIG. 12, there is shown an exploded view of an alternate embodiment of a safe 3 and how it may be fitted within a bag 1. The opened safe 3 is shown here with fitted trays 29 that may be optionally used to keep valuables organized. Also shown is the safe 3 with attached loop cable 4. In this embodiment, the loop cable at an end proximate to the safe may incorporate an eyelet (not shown) at an end proximate to the safe, and may be anchored to the outside of the safe 3 by way of an integrally secured pin, screw, bolt or any similar securement means. The base 31 shown in this figure is screwed into the top of the safe 3 so that it cannot be readily removed. The base 31 may optionally be of the type that may swivel and rotate for convenient use of the safe by the user from multiple angles. The loop cable 4 also includes lock 30 incorporated at an end distal to the safe, which may be used to lock the cable 4 to itself to form a loop. Use of this configuration of loop cable 4 is advantageous as it only requires one aperture in the outer bag 1. Such a loop cable 4 is therefore more readily installed in a bag 1 than an embodiment requiring multiple apertures.

Safe 3 may be inserted into housing 25 as shown. In this embodiment, housing 25 has on its bottom end a VELCRO™ pad (not shown) which has been attached by means such as adhesive or stitching. Shown below the housing 25 is a complementary VELCRO™ pad 32 which mates with the corresponding pad on the bottom of the housing 25. The pad 32 may be secured into bag 1 by adhesive or stitching or any other known securement means.

In use, the safe 3 and housing 25 may thus be secured into and used in association with bag 1. Loop cable 4 may protrude from the bag through an aperture made specifically for that purpose as previously mentioned and described. Alternatively loop cable 4 may protrude through an existing opening 33 as shown. In such a case, if opening 33 is equipped with two opposed zipper pulls which traverse the perimeter of the opening 33, then the zipper pulls may be temporarily secured together around the protruding loop cable 4. The zipper pulls may be secured by any standard means such as small combination luggage locks or small keyed padlocks.

The invention described above is, to the best of the inventor's knowledge, the first practical means of seamlessly securing a safe and bag to a fixed object simultaneously. The invention is expected to permit users to store their valuables on-the-go in a manner more secure and discreet than previously permitted given the limitations in known bags with security features and other portable safes.

While the invention has been described with reference to specific embodiments, it will be appreciated that numerous variations, modifications, and embodiments are possible. For instance, various shapes, sizes and styles of the bag are anticipated by the inventor. One embodiment of the bag may be optimized for transporting athletic equipment such as hockey gear, while another may be optimized for outdoor activities such as hiking or outings at a park or beach. Additionally, the loop cable system and safe enclosure may take an alternative form, while serving the same function. Accordingly, all variations, modifications and embodiments are to be regarded as being within the spirit and scope of the invention.

What is claimed is:

1. A kit for installation of a safe into an interior of a bag, comprising:
   said safe being securable to an external structure, said safe further comprising:
      a hollow container having at least five sides and a lockable door for accessing an interior of said container, said sides and door of said hollow container defining an interior safe volume;
      a securing device connected to said container, said securing device being removably securable to the external structure, wherein
      said securing device is selected from the group consisting of a cable or wire, said securing device further comprising a lock with which to secure said safe to said external structure;
   said bag having an interior bag volume;
   a housing for removably restraining said safe; and
   mounting means to mount said housing into said interior of said bag,
   wherein said interior safe volume occupies less than half of the interior bag volume.

2. A kit of claim 1, wherein said housing restrains said safe by one of the following restraining means: hook and loop closure, snappable flange, integrally formed loops with a clasp, clips, or a latch.

3. A kit of claim 1, wherein said mounting means consists of a first hook and loop pad attached to the housing, which mates with a second hook and loop pad that can be mounted into said bag.

4. A kit of claim 3, additionally comprising reinforcement means to reinforce an exit point in the bag for said securing device.

5. A portable device for the storage of valuables, comprising a safe that is securable to an external structure, said safe comprising:
   a hollow container having at least five sides and a lockable door for accessing the interior of said container, said sides and door of said hollow container defining an interior safe volume;
   a securing device connected to said container, said securing device removably securable to the external structure, wherein said securing device is selected from the group consisting of a cable and wire, said securing device further comprising a lock with which to secure said safe to said external structure;
   said portable device, further comprising:
      a bag having an interior and an exterior, said bag interior having a bag interior volume, wherein said interior safe volume occupies less than half of the interior bag volume;
      a housing for said safe, said housing being mounted into the interior of said bag,
      wherein said bag having at least one aperture configured to accommodate said securing device.

6. The portable device of claim 5, further comprising reinforcement means around said at least one aperture.

7. The portable device of claim 5, wherein said housing restrains said safe by one of the following restraining means: hook and loop closure, snappable flange, integrally formed loops with a clasp, clips, or a latch.

8. The portable device of claim 5, wherein the housing is mounted using a first hook and loop pad attached to the housing, which mates with a second hook and loop pad that is mounted into said bag.

9. The portable device of claim 5, additionally comprising a cover for said at least one aperture.

10. A portable device for the storage of valuables, comprising a safe that is securable to an external structure, said safe comprising:

a hollow container having at least five sides and a lockable door for accessing the interior of said container, said sides and door of said hollow container defining an interior safe volume;

a securing device connected to said container, said securing device removably securable to the external structure, wherein said securing device is selected from the group consisting of a cable and wire, said securing device further comprising a lock with which to secure said safe to said external structure;

said portable device further comprising:

a bag having an interior and an exterior, said bag interior having a bag interior volume, wherein said interior safe volume occupies less than half of the bag interior volume;

a housing for said safe, said housing being mounted into the interior of said bag, said housing including a cutout to expose a corresponding portion of an exterior surface of said safe when installed in said housing, to facilitate removal of said safe from said housing;

wherein said bag having at least one aperture configured to accommodate said securing device.

11. The portable device of claim 10, wherein the housing is mounted using a first hook and loop pad attached to the housing, which mates with a second hook and loop pad that is mounted into said bag.

12. The portable device of claim 10, additionally comprising a cover for said at least one aperture.

* * * * *